US010474067B2

(12) United States Patent
Sabo et al.

(10) Patent No.: US 10,474,067 B2
(45) Date of Patent: Nov. 12, 2019

(54) DEVELOPER INLETS

(71) Applicant: Hewlett-Packard Development Company, L.P., Houston, TX (US)

(72) Inventors: David Sabo, San Diego, CA (US); Eric G. Nelson, Eagle, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/760,306

(22) PCT Filed: Sep. 30, 2015

(86) PCT No.: PCT/US2015/053190
§ 371 (c)(1),
(2) Date: Mar. 15, 2018

(87) PCT Pub. No.: WO2017/058198
PCT Pub. Date: Apr. 6, 2017

(65) Prior Publication Data

US 2018/0259882 A1 Sep. 13, 2018

(51) Int. Cl.
*G03G 15/10* (2006.01)
*G03G 13/10* (2006.01)

(52) U.S. Cl.
CPC ..... *G03G 15/104* (2013.01); *G03G 13/10* (2013.01)

(58) Field of Classification Search
CPC ..... G03G 15/104
See application file for complete search history.

(56) References Cited

U.S. PATENT DOCUMENTS

| | | | | |
|---|---|---|---|---|
| 3,651,782 | A | 3/1972 | MacDonald, Jr. | |
| 4,398,818 | A | 8/1983 | Jeromin et al. | |
| 4,421,056 | A | 12/1983 | Schinke | |
| 6,108,507 | A | 8/2000 | Chang et al. | |
| 8,965,250 | B2 * | 2/2015 | Komatsu | G03G 15/0872 399/260 |
| 2006/0067739 | A1 | 3/2006 | Kang et al. | |
| 2008/0141882 | A1 | 6/2008 | Sabo et al. | |
| 2012/0114392 | A1 | 5/2012 | Ushikubo | |
| 2013/0011162 | A1 | 1/2013 | Nelson et al. | |
| 2014/0003840 | A1 | 1/2014 | Onishi et al. | |
| 2015/0078785 | A1 * | 3/2015 | Tanner | G03G 15/101 399/238 |
| 2015/0125176 | A1 | 5/2015 | Fujii et al. | |

FOREIGN PATENT DOCUMENTS

WO WO-2013151562 10/2013

* cited by examiner

*Primary Examiner* — David M. Gray
*Assistant Examiner* — Michael A Harrison
(74) *Attorney, Agent, or Firm* — HP Inc. Patent Department

(57) ABSTRACT

An example developer unit includes a developer roller. The developer unit also includes a set of electrodes proximate to the developer roller. The set of electrodes form a cavity. The developer unit includes an inlet to the cavity. The inlet is to receive printing fluid. The developer unit includes an insert in the inlet. The insert is to distribute the printing fluid evenly in the cavity.

14 Claims, 11 Drawing Sheets

600a

600b

700a

700b

800a

800b

900a

900b

DEVELOPER INLETS

BACKGROUND

Electro-photography (EP) printing devices may form images on print media by selectively charging or discharging a photoconductive member, such as a photoconductive drum, based on an image to be printed. The selective charging or discharging may form a latent electrostatic image on the photoconductor. Colorants, or other printing fluids, may be developed onto the latent image of the photoconductor, and the colorant or printing fluid may be transferred to the media to form the image on the media. In dry EP (DEP) printing devices, powdered toner may be used as the colorant, and the toner may be received by the media as the media passes below the photoconductor. The toner may be fixed in place as it passes through heated pressure rollers. In some liquid EP (LEP) printing devices, printing fluid may be used as the colorant instead of toner. In some LEP devices, printing fluid may be developed in a developer unit and then selectively transferred to the photoconductor (a "zero transfer"). For example, the printing fluid may have a charge that causes it to be electrostatically attracted to the latent image on the photoconductor. The photoconductor may transfer the printing fluid to an intermediate transfer member (ITM), which may include a transfer blanket, (a "first transfer"), where it may be heated until a liquid carrier evaporates, or substantially evaporates, and resinous colorants melt. The ITM may transfer the resinous colorants to the surface of the print media (a "second transfer"), which may be supported on a rotating impression member (e.g., a rotating impression drum).

DETAILED DESCRIPTION

The developer unit may receive printing fluid from a reservoir and provide the printing fluid to a developer member, such as a developer roller. The printing fluid may be developed on the developer roller, and the developer roller may transfer the developed printing fluid to the photoconductor. The developer unit may include a set of electrodes that form a cavity (e.g., a main electrode, a back electrode, etc.). Printing fluid may be delivered to the cavity by a conduit (e.g., a pipe, a hose, a channel, or the like). The pressure of the printing fluid from the conduit may force the printing fluid through a channel to the developer roller.

The conduit may deliver the printing fluid to a first end of the cavity. The printing fluid may exit the conduit as a jet. The pressure/velocity of the printing fluid as it exits may cause the printing fluid to travel to a second end of the cavity opposite the first end. The printing fluid may be at high pressure at the second end of the cavity due to the incoming jet. The jet may pull printing fluid from the first end, and little printing fluid may flow to the first end. As a result, the printing fluid may be at a low pressure at the first end of the cavity.

The low pressure at the first end may result in poor print quality. If the pressure is too low, the printing fluid may not flow over the back electrode. The lack of flow may prevent development of the printing fluid from occurring at the back electrode. As a result, the optical density of the printing fluid may be reduced, and flow streaks may appear in the printing fluid on the developer roller. These defects may transfer to the print media. In extreme cases, there may even be a complete starvation of printing fluid. The high pressure at the second end may increase the amount and velocity of printing fluid flowing through the channel towards the developer roller. A splashguard may be unable to contain the increased flow of printing fluid, and the printing fluid may leak over the splashguard. Accordingly, there is a need for a device to cause printing fluid to be output to a developer roller at a uniform pressure and velocity.

Figure 1A:
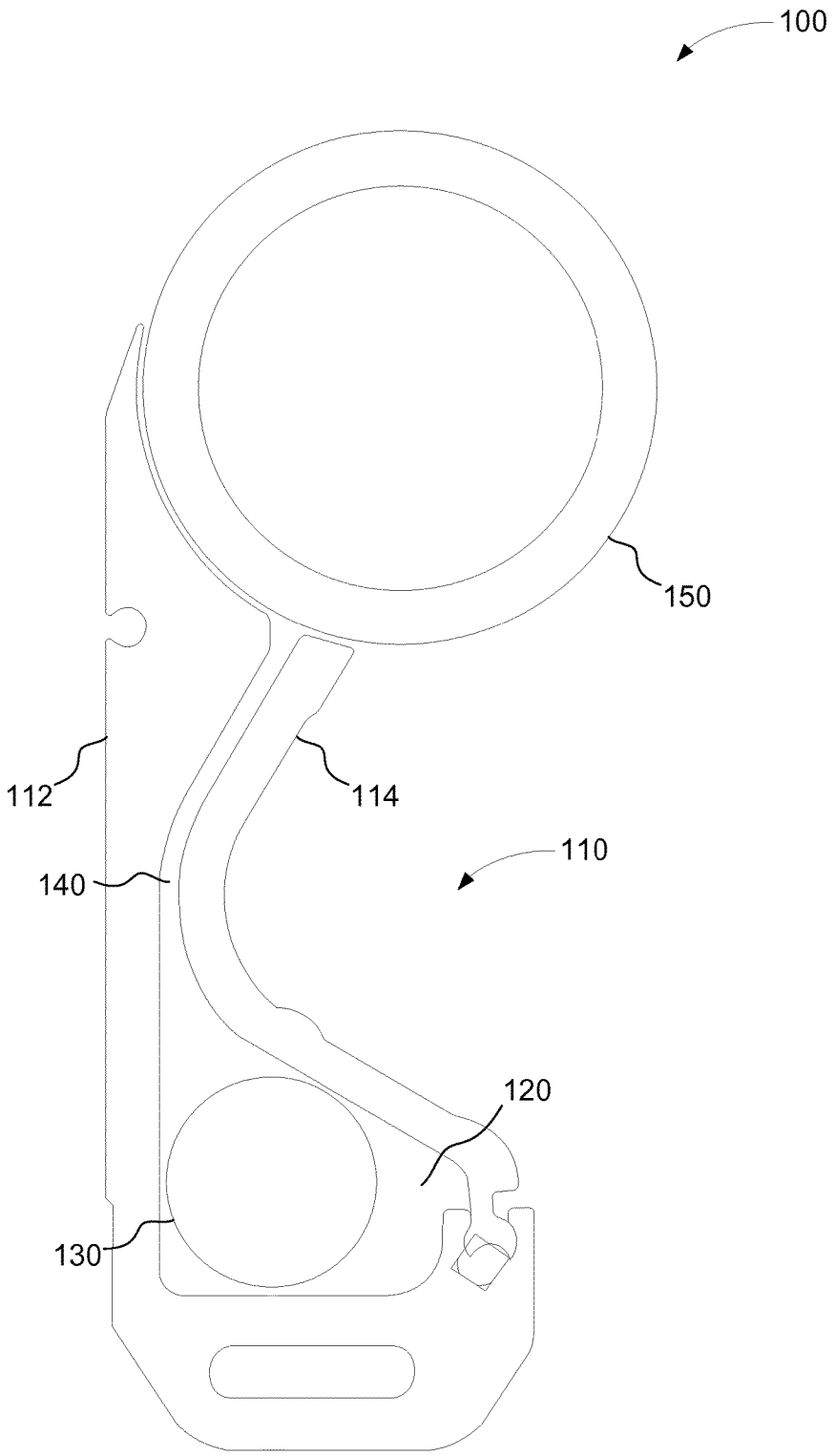
FIG. 1A is a lateral, cross-section view of an example developer unit to deliver printing fluid to a developer roller at a uniform pressure.

FIG. 1A is a lateral, cross-section view of an example developer unit 100 to deliver printing fluid to a developer roller 150 at a uniform pressure. As used herein, the term "lateral" refers to planes, lines, vectors, etc. orthogonal to an axis of the developer roller 150. As used herein, the term "longitudinal" refers to planes, lines, vectors, etc. parallel or coinciding with the axis of the developer roller 150. The developer unit 100 may include a set of electrodes 110. The set of electrodes 110 may include a main electrode 112 and a back electrode 114. The set of electrodes 110 may form a cavity 120. A channel 140 may be connected to the cavity 120. The channel 140 may carry the printing fluid from the cavity 120 to the developer roller 150. For example, the pressure of the printing fluid may cause printing fluid to flow up the channel 140 to the developer roller 150.

An inlet 130 may deliver the printing fluid to the cavity 120. For example, the inlet 130 may be coupled to a printing fluid reservoir (not shown) by a conduit (not shown). The size of the inlet 130 may be maximized. For example, the inlet 130 may not include anything that might restrict the flow of printing fluid to a single narrow passage and cause it to enter the cavity 120 as a narrow jet. In an example, the inlet diameter may be at least as large as the diameter of the conduit. In such an example, there may be no locations along the inlet 130 at which the diameter is less than that of the conduit. The pressure and velocity of printing fluid entering through a large inlet may be lower than the pressure and velocity of printing fluid entering an inlet narrower than the conduit. Accordingly, the pressure at the second end may not be as high as with a narrow inlet. In addition, the widening may cause more printing fluid to be directed to the first end, and the pressure at the first end may be higher than it would be with a narrow inlet.

Figure 1B:
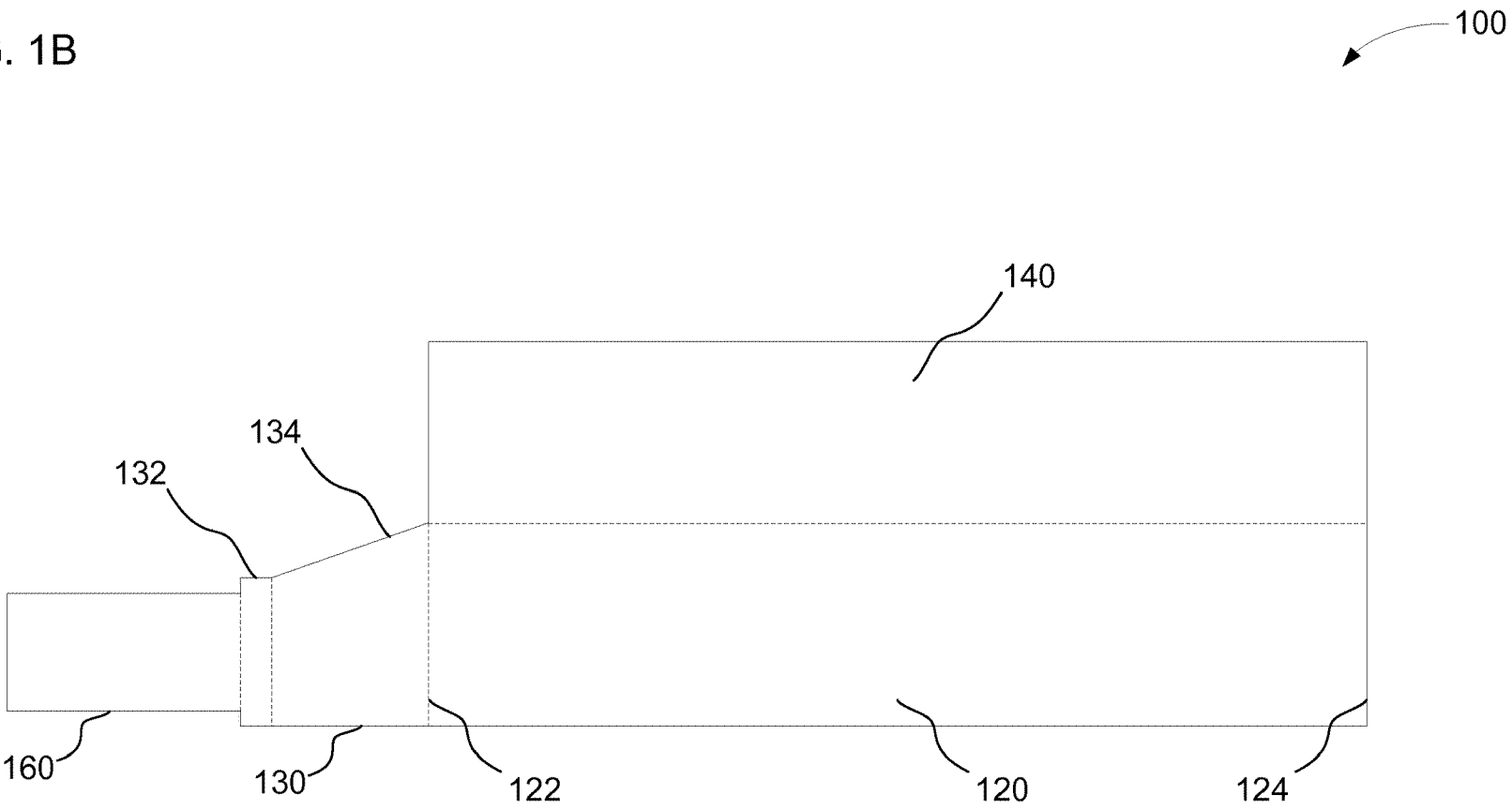
FIG. 1B is a longitudinal, cross-section view of the example developer unit to deliver the printing fluid to the developer roller at the uniform pressure.

FIG. 1B is a longitudinal, cross-section view of the example developer unit 100 to deliver the printing fluid to the developer roller 150 at the uniform pressure. The inlet 130 may be at a first end 122 of the cavity 120, and a second end 124 of the cavity 120 may be opposite the first end 122. The inlet 130 may include an endcap 132 that couples the inlet 130 to a conduit 160. The inlet 130 may widen from a size of the conduit 160 to a size of the cavity 120. As used herein, the term "widen" refers to an increase in the lateral cross-sectional area of the inlet 130 between a first location on the inlet axis after printing fluid leaves the conduit 160 and a second location on the inlet axis further from the conduit 160 than the first location. As used herein, the term "cross-sectional area" refers to the lateral cross-sectional area. As used herein, the term "inlet axis" refers to an axis parallel to the developer roller axis and equidistant from an inner surface of the endcap 132 where it meets the conduit 160. For example, the inlet 130 may include an increase in cross-sectional area between a location where the endcap 132 meets the conduit 160 and an end of the inlet 130 nearest the cavity 120.

In an example, the inlet 130 may include a tapered portion 134. The tapered portion 134 may taper outward from the endcap 132 to the size of the cavity 120. As used herein, the term "taper outward" refers to a continuous and constant increase in cross-sectional area between a first location and a second location. For example, the tapered portion 134 may taper outward at a constant slope. As used herein, the term "slope" refers to a change in the lateral distance from the inlet axis to a line coplanar with the inlet axis (e.g., a line on the inner surface of the inlet) between first and second locations on the line divided by the longitudinal distance along the inlet axis between the first and second locations, or the term "slope" refers to an arctangent of the quotient so computed. In some examples, the slope may be the same for all lines on the inside surface of the tapered portion 134 that are coplanar with the inlet axis. Alternatively, or in addition, there may be differently sloped lines based on variations in the shape of the cavity 120. In some examples, the inlet 130 may taper out at slopes no greater than a threshold, such as 15, 20, 30, 45, 60, etc. degrees (i.e., all lines on the inside surface of the tapered portion 134 that are coplanar with the inlet axis may have a slope no greater than the threshold). Some lines may have a slope near zero and remain a constant distance from the inlet axis while others widen more quickly. In the illustrated example, one side widens at a constant slope while another side does not widen and has a slope near zero.

In other examples, the inlet 130 may widen without tapering. In an example, the widening of the inlet 130 may not be constant, and the inner surface of the inlet 130 may form a curve of varying slope that is coplanar with the inlet axis. The curve may be, for example, polynomial, exponential, or the like. In an example, the widening of the inlet 130 may not be continuous. The inlet 130 may widen in a plurality of steps with no change in cross-sectional area between the steps. The slopes between steps may be constant or varying. The widening of the inlet 130 may further reduce the pressure and velocity of incoming printing fluid. The printing fluid may spread as it encounters the widening cross-section, which may result in the reduction in pressure and velocity. As a result, the pressure at the second end 124 may be reduced relative to an inlet without widening, and the pressure at the first end 122 may be higher.

Figure 2:
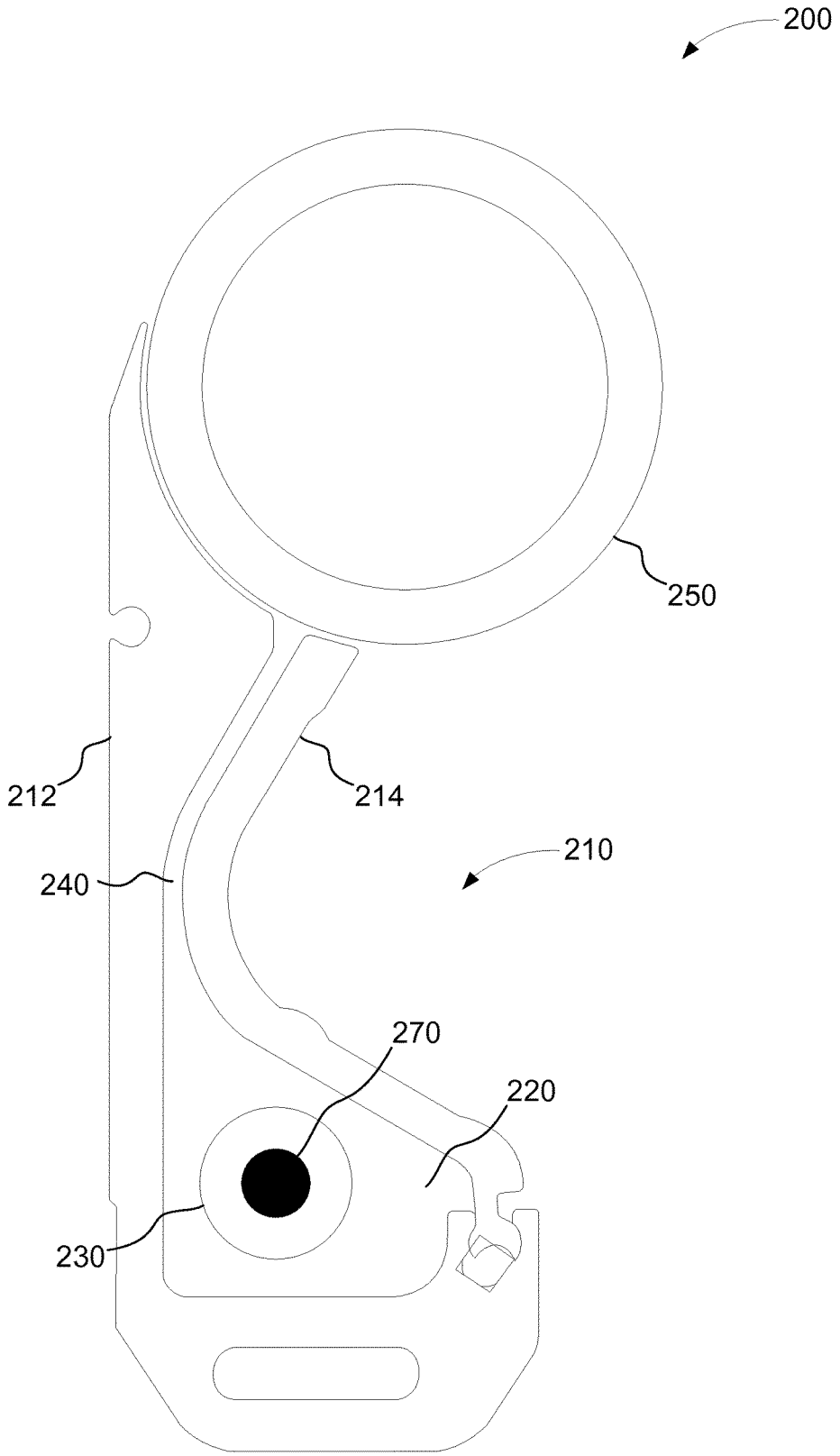
FIG. 2 is a lateral, cross-section view of another example developer unit to deliver printing fluid to a developer roller at a uniform pressure.

FIG. 2 is a lateral, cross-section view of another example developer unit 200 to deliver printing fluid to a developer roller 250 at a uniform pressure. The developer unit 200 may include a set of electrodes 210. The set of electrodes 210 may include a main electrode 212 and a back electrode 214. The set of electrodes 210 may form a cavity 220 to receive printing fluid from an inlet 230. The pressure of the printing fluid received from the inlet 230 may force printing fluid through a channel 240 and to the developer roller 250.

The developer unit 200 may include an insert 270. As used herein, the term "insert" refers to an object in a fixed location that modifies the flow of printing fluid in the cavity 220. The insert may be made of a polymer, a metal, a carbon based compound, or the like. The insert 270 may be located in the inlet 230 or the cavity 220. The insert 270 may redirect the flow of the printing fluid in the inlet 230 or cavity 220 irrespective of the insert's location. The insert 270 may be in a path of the printing fluid. For example, the insert 270 may be located where the printing fluid enters the inlet 230, at a location after the printing fluid enters the inlet 230, or the like. In an example, the insert 270 may be located or centered along the inlet axis. The insert 270 may redirect the printing fluid towards the faces and edges of the cavity 220 and away from a center of the cavity 220. As used herein, the term "face" refers to an approximately flat portion of the surface that encloses the cavity 220 (i.e., a flat portion of the surfaces of the set of electrodes 210 that define the cavity 220), and the term "edge" refers to an area on the surface joining two faces. For example, an edge may be a rounded portion of the surfaces of the set of electrodes 210 that is between two faces. In an example, the insert 270 may force arriving printing fluid to flow laterally towards the faces and edges before the printing fluid can continue flowing longitudinally.

The insert 270 may also, or instead, disrupt the flow of the printing fluid. The pressure and velocity of the printing fluid may be less after it has been redirected or disrupted by the insert 270. The redirection and disruption may reduce the pressure of printing fluid exiting the channel 240 at a second end relative to an example without an insert. The flow of printing fluid to a first end of the cavity 220 may be increased by the redirection and disruption of the printing fluid flow by the insert 270. The redirection or disruption of printing fluid by the insert 270 at the first end of the cavity 220 may increase the pressure of printing fluid exiting the channel 240 at the first end relative to an example without an insert. Thus, the redirection and disruption by the insert 270 may cause printing fluid to be delivered to the developer roller 250 at a more uniform pressure.

In some examples, the inlet 230 may be restricted, so the printing fluid may enter the cavity 220 in a narrow jet. The narrow jet may impact the insert 270 and may travel around the insert 270, which may change the pressure and velocity of the incoming printing fluid. The insert 270 absorb some of the pressure/velocity of the printing fluid and may redirect some of the pressure/velocity to portions of the cavity 220 that would otherwise be at a lower pressure. In some examples, the inlet 230 may be unrestricted and have a large cross-sectional area. The insert 270 and the large cross-sectional area may cooperate to cause the printing fluid to exit the channel 240 and arrive at the developer roller 250 at a more uniform pressure than with either element alone.

In an example, the inlet 230 may widen, and the insert 270 may direct printing fluid into the widened portion of the inlet 230. Without the insert 270, the widening may reduce the pressure of the incoming printing fluid, but printing fluid at the widened portion and at the first end may remain at a lower pressure than printing fluid at the second end. The printing fluid at the second end may still be affected by the pressure and velocity of the printing fluid entering at the inlet 230. The insert 270 may direct printing fluid towards the widened portion, which may increase the printing fluid pressure at the first end. The insert 270 may also obstruct the incoming printing fluid, which may prevent the velocity of the incoming printing fluid from affecting the pressure of the printing fluid at the second end. As a result, the printing fluid delivered to the developer roller may have a more uniform pressure when the insert 270 is included in combination with the widening compared to only widening the inlet 230 or only including the insert 270.

Figure 3A:
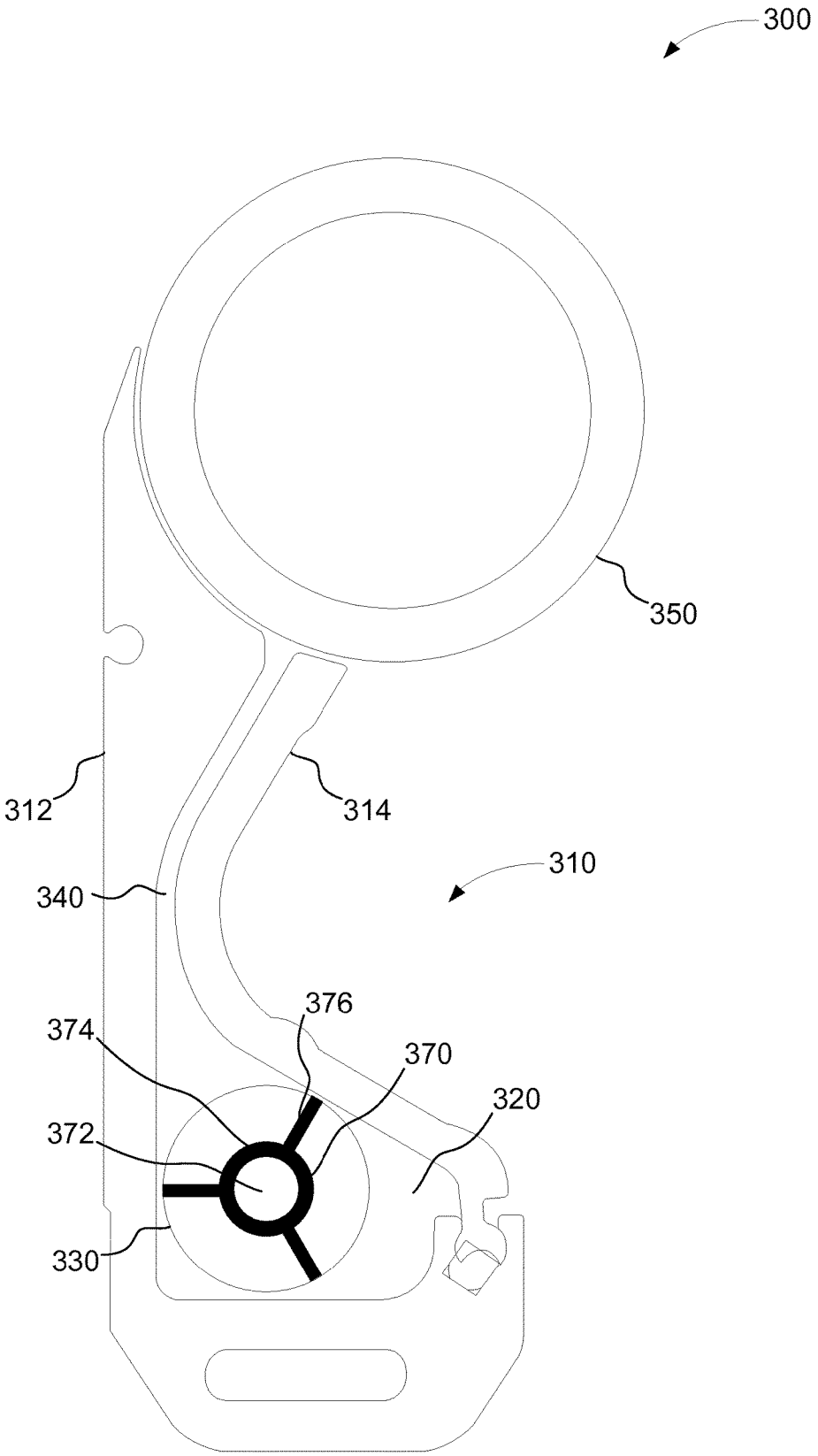
FIG. 3A is a lateral, cross-section view of an additional example developer unit to deliver printing fluid to a developer roller at a uniform pressure.

FIG. 3A is a lateral, cross-section view of an additional example developer unit 300 to deliver printing fluid to a developer roller 350 at a uniform pressure. The developer unit 300 may include a set of electrodes 310 (e.g., a main electrode 312, a back electrode 314, etc.). The set of electrodes 310 may form a cavity 320. The cavity 320 may receive printing fluid from an inlet 330. The pressure of printing fluid in the cavity 320 may cause printing fluid to flow to the developer roller 350 through a channel 340.

The developer unit 300 may include an insert 370. The insert 370 may be located in the inlet 330 or the cavity 320 and may modify the flow of printing fluid in the inlet or the cavity 320. In the illustrated example, the insert 370 may include a hole 372 in the center when viewing a lateral cross-section and a solid ring 374 surrounding the hole 372. The hole 372 may permit printing fluid to travel through the insert 370 towards a center of the cavity 320. In an example, an insert 370 without a hole may cause the pressure of the printing fluid at the first end to increase too much and the pressure of the printing fluid at the second end or in the middle between the two ends to decrease too much. For example, there may be a spike in pressure or velocity at the first end.

The size of the ring 374 (e.g., the diameter) and the size of the hole 372 (e.g., the diameter) may be selected to moderate the printing fluid pressure at the second end while preventing a low-pressure shadow from forming behind the insert 370. The positioning and number of holes 372 may also be adjusted to control the pressure of printing fluid being delivered to the developer roller 350 at various locations between the first and second ends. In the illustrated example, the hole 372 is coaxial with the ring 374, but in other examples, the hole 372 may not be coaxial with the ring 374. The hole 372 or ring 374 may also form cross-sectional shapes other than circles, such as squares, triangles (e.g., with corners oriented towards edges of the cavity 320, with corners oriented towards faces of the cavity 320, etc.), or the like.

The insert 370 may include a plurality of ribs 376. The plurality of ribs 376 may support the ring 374 and hold it in a fixed location. The plurality of ribs 376 may connect the ring 374 to the inlet 330 or the cavity 320. The plurality of ribs 376 may also redirect printing fluid. In the illustrated example, the plurality of ribs 376 are approximately aligned with the faces of the surface, and the gaps between the plurality of ribs 376 are approximately aligned with edges of the surface. The plurality of ribs 376 may direct incoming printing fluid towards the edges to diffuse the flow of the incoming printing fluid while allowing the printing fluid to travel to the second end. In other examples, there may be more or fewer ribs, and the positions of the ribs may be different from the illustrated example. The plurality of ribs 376 are illustrated as being positioned in an approximately symmetrical configuration, but in other examples, the plurality of ribs 376 may in asymmetrical positions.

Figure 3B:
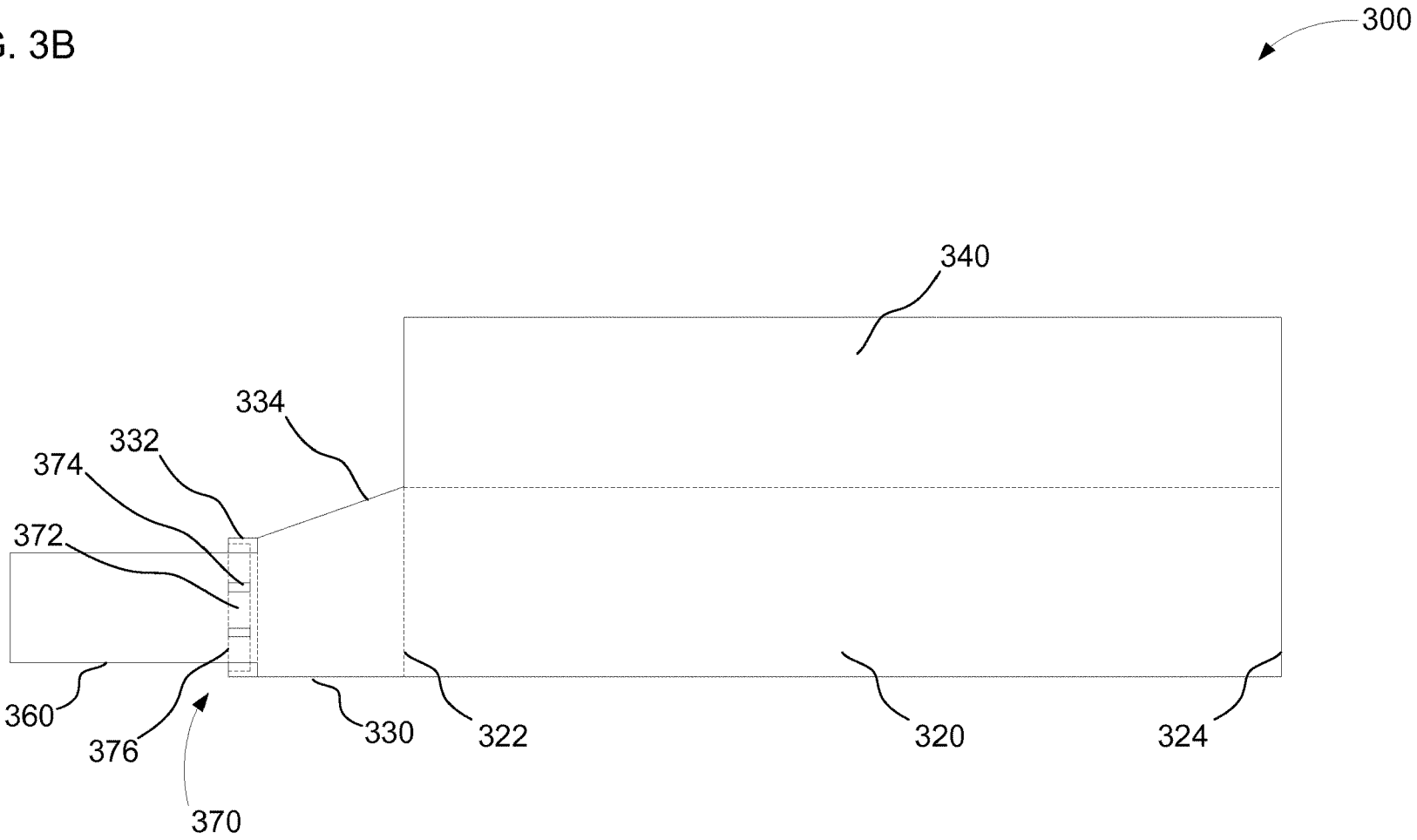
FIG. 3B is a longitudinal, cross-section view of the additional example developer unit to deliver the printing fluid to a developer roller at the uniform pressure.

FIG. 3B is a longitudinal, cross-section view of the additional example developer unit 300 to deliver the printing fluid to the developer roller 350 at the uniform pressure. The inlet 330 may extend from an endcap 332 where it connects to a conduit 360 to a first end 322 of the cavity 320. A second end 324 of the cavity 320 may be opposite the first. In the illustrated example, the insert 370 may be attached to the endcap 332. In an example, the insert 370 may be molded into the endcap 332, may be part of the endcap 332, or the like. In other examples, the insert 370 may be situated at locations in the inlet 330 or the cavity 320 other than the endcap 332. For example, the insert 370 may situated at a position closer to the endcap 332 than to the first end 322 of the cavity 320. Positioning the insert 370 towards the endcap 332 may allow time for the flow of the printing fluid to become smoother and more laminar after it passes the insert 370.

In the illustrated example, the insert 370 has a uniform size in its lateral dimensions for the entirety of its depth in a longitudinal direction. For example, the plurality of ribs 376 may have a same cross-sectional area and position at a side closest to the conduit 360 as at a side closest to the cavity 320. Similarly, the hole 372 and the ring 374 may have same sizes (e.g., diameters) and positions at the side closest to the conduit 360 as at the side closest to the cavity 320. In alternate examples, the cross-sectional areas, diameters, positions, etc. may vary to aid in redirecting the printing fluid.

Figure 4:
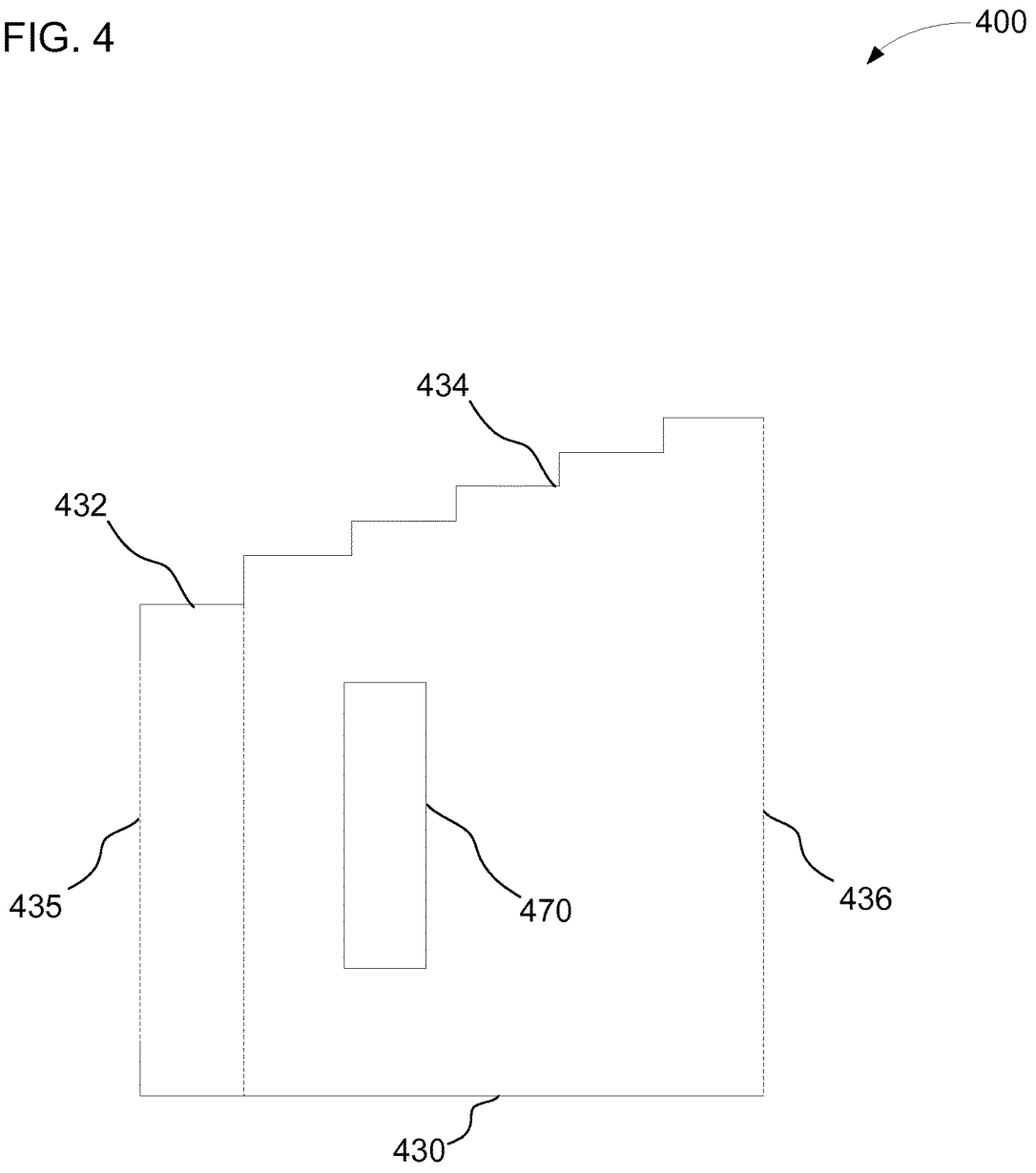
FIG. 4 is a longitudinal, cross-section view of an example interface to deliver printing fluid to a developer unit.

FIG. 4 is a longitudinal, cross-section view of an example interface 400 to deliver printing fluid to a developer unit. The interface 400 may include a body 430. The body 430 may include a distal end 435 and a proximal end 436. The distal end 435 may be able to connect to a conduit (not shown). The proximal end 436 may be attached to or able to connect to a developer unit electrode cavity (not shown). The body 430 may widen from the distal end 435 to the proximal end 436. For example, an inner surface of the body 430 may increase in size from a size of the conduit at the distal end 435 to a size of the developer unit electrode cavity at the proximal end 436. In the illustrated example, the body 430 may widen in a step pattern. For example, the body may include a stepped portion 434. The stepped portion 434 may widen steeply at a plurality of discrete locations. Different sides of the body may widen at different rates even if they are a same longitudinal distance from the distal or proximal ends 435, 436. In the illustrated example, the bottom side may not widen as quickly as the top side or may not widen at all.

The interface 400 may include an insert 470. The illustrated insert 470 does not include a hole in the center, but other inserts may have such a hole. The insert 470 may obstruct a flow of printing fluid received at the distal end 435 and may redirect the printing fluid. For example, the insert 470 may direct the printing fluid along an inner surface of the body 430. In the illustrated example, incoming printing fluid may reach the insert 470 and need to move laterally before it can continue its original course. The lateral movement may create an outward pressure directing printing fluid towards the inner surface of the body.

The interface 400 may include an endcap 432. The endcap 432 may be able to couple the interface 400 to the conduit. The insert 470 may be located at a different longitudinal position than the endcap 432. In the illustrated example, the insert 470 is closer to the distal end 435 than the proximal end 436, for example, to allow the flow of the printing fluid to achieve a more uniform velocity before it reaches the proximal end 436 of the interface 400. In alternate examples, the insert 470 may be located in other locations, such as a location closer to the proximal end 436 than the distal end 435.

Figure 5:
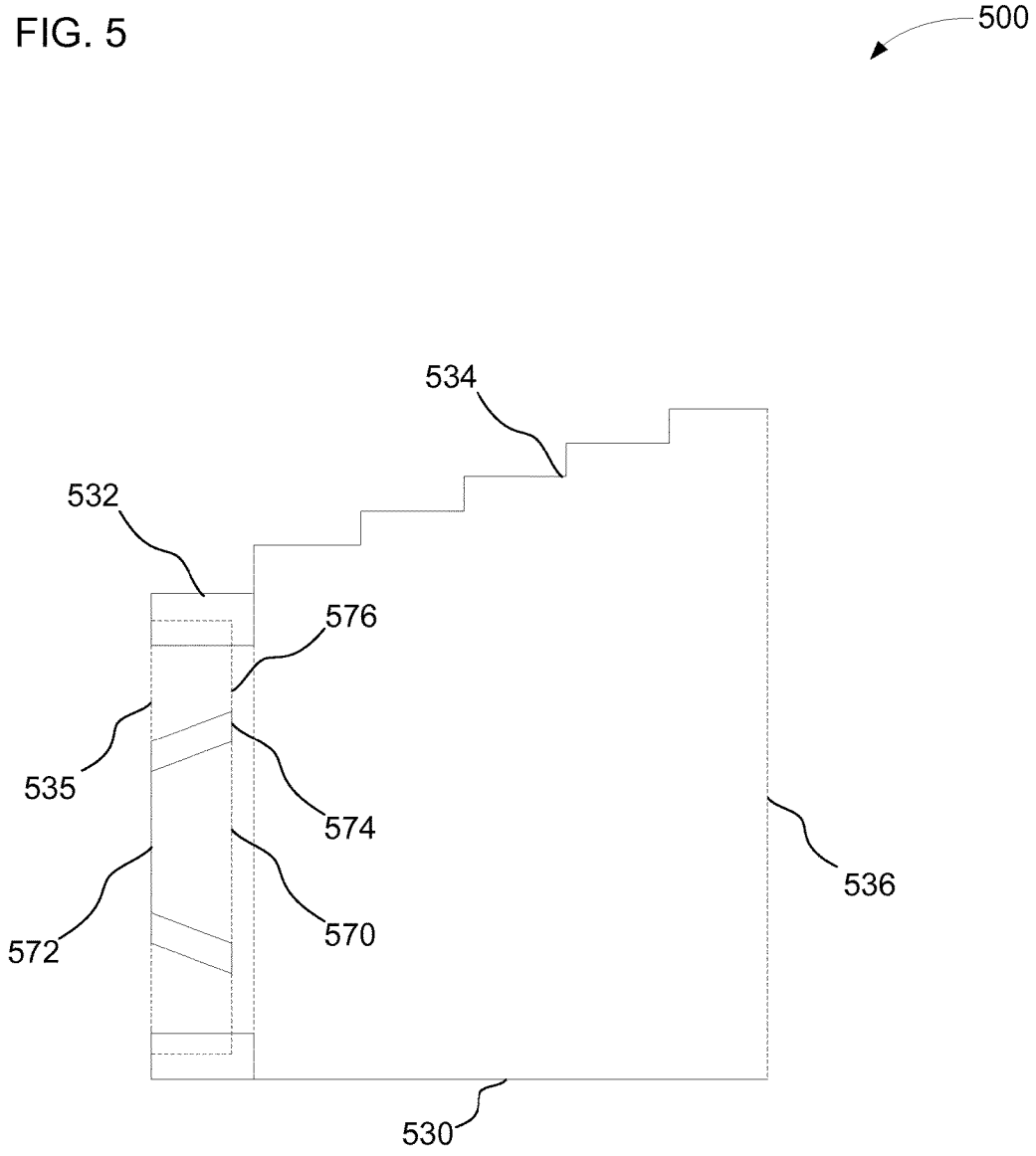
FIG. 5 is a longitudinal, cross-section view of another example interface to deliver printing fluid to a developer unit.

FIG. 5 is a longitudinal, cross-section view of another example interface 500 to deliver printing fluid to a developer unit. The interface 500 may include a body 530 with a distal end 535 and a proximal end 536. The body 530 may include an endcap 532 at the distal end 535. The endcap 532 may be able to connect to a conduit (not shown). The proximal end 536 may be attached to or able to connect to a developer unit electrode cavity (not shown). The body 530 may widen from a size of the conduit to a size of the electrode cavity between the distal end 535 and the proximal end 536. For example, the body 530 may taper outward, may widen outward in a plurality of steps, or the like. In the illustrated example, the body 530 may include a stepped portion 534 on a top side of the cross-section while a bottom side may include minimal or no widening relative to an inlet axis.

The interface 500 may include an insert 570. The insert 570 may include a hole 572, a ring 574, and a plurality of ribs 576. In some examples, the insert 570 may not have a uniform size in its lateral dimensions for the entirety of its depth. In the illustrated example, the hole 572 and the ring 574 may increase in size (e.g., diameter) from a side closest to the distal end 535 to a side closest to the proximal end 536. The increase in diameter of the ring 574 may direct the incoming flow of printing fluid along the walls of the body 530 as they widen, and the increase in diameter of the hole 572 may reduce the pressure and velocity of the portion of the incoming flow traveling through the hole 572. In other examples, one of the hole 572 and the ring 574 may increase in diameter, or a cross-sectional area or location of one of the plurality of ribs 576 may change along its depth. For example, the plurality of ribs 576 may include a pitch that results in changes in location along their depth.

Figure 6A:
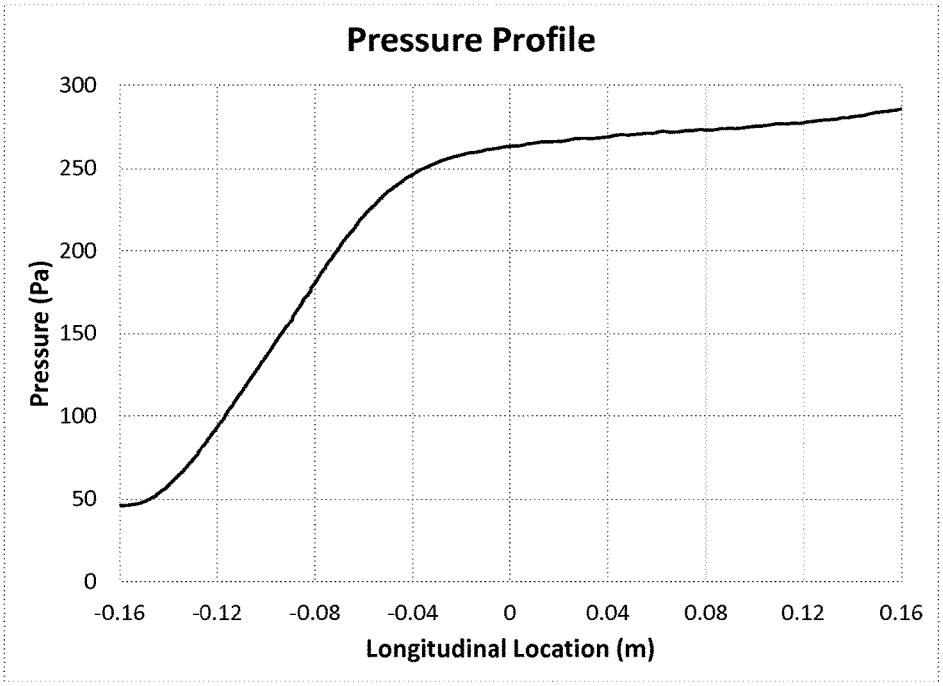
FIGS. 6A-6B are charts of example pressures and velocities of printing fluid slightly below where it leaves a channel and arrives at a developer roller for an example developer unit.
Figure 6B:
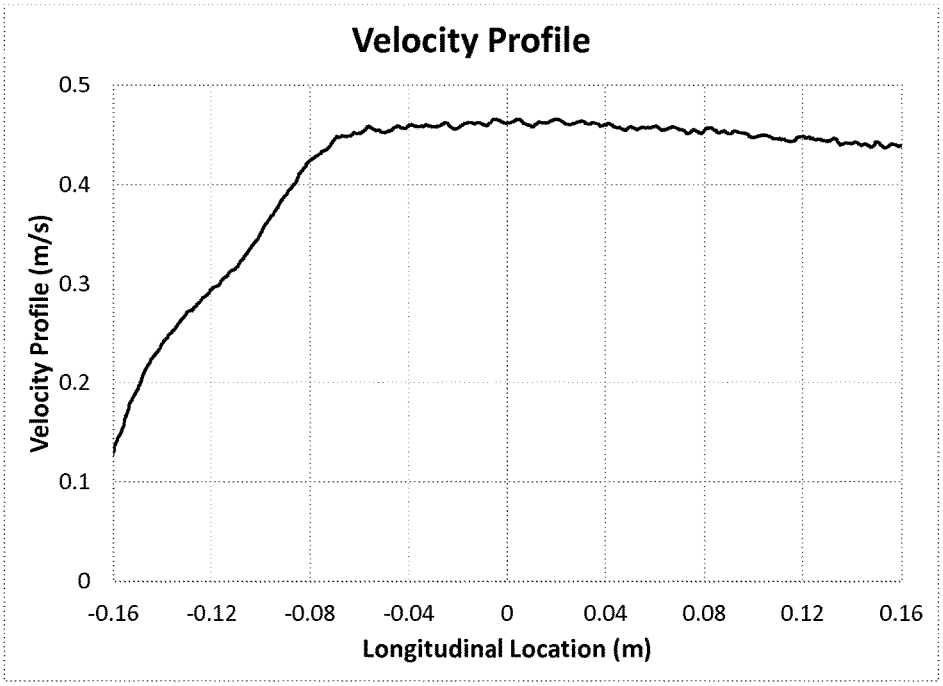

FIGS. 6A-6B are charts 600*a*, 600*b* of example pressures and velocities of printing fluid slightly below where it leaves a channel and arrives at a developer roller for an example developer unit. In an example, the charts 600*a*, 600*b* are measured along a line from the first end to the second end in the center of the channel 2 millimeters (mm) below the exit of the channel. In the charts 600*a*, 600*b*, positive location values indicate locations closer to the second end, and negative location values indicate locations closer to the first end. The example developer unit may include an inlet without widening and without an insert. In a pressure chart 600*a*, a pressure at a second end of the channel may be significantly larger than a pressure at a first end of the channel. Similarly, in a velocity chart 600*b*, the velocity is much smaller at the first end than it is at the second end.

Figure 7A:
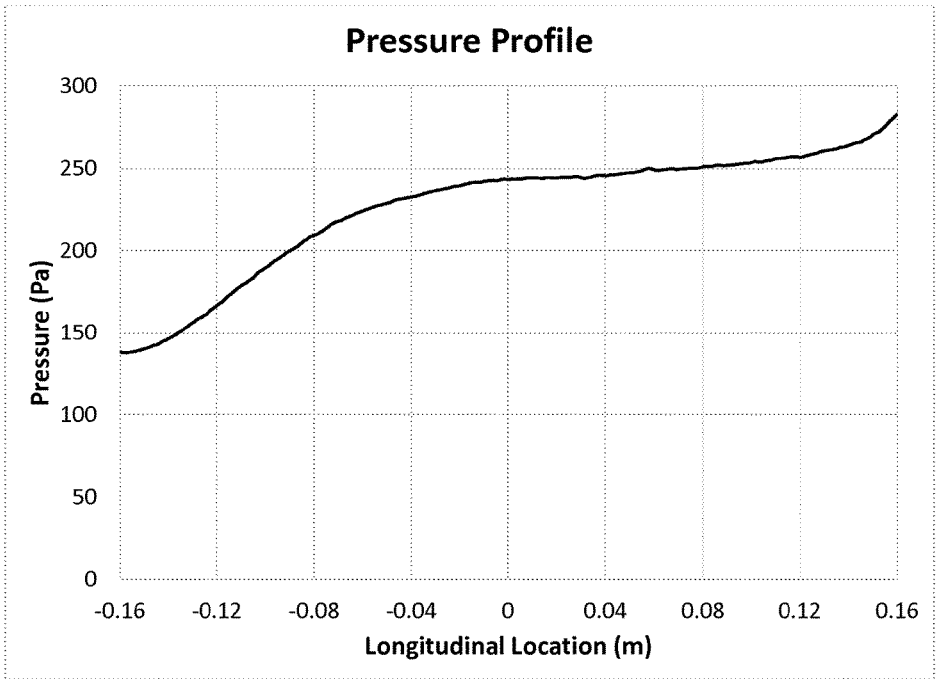
FIGS. 7A-7B are charts of example pressures and velocities of printing fluid slightly below where it leaves a channel and arrives at a developer roller for another example developer unit.
Figure 7B:
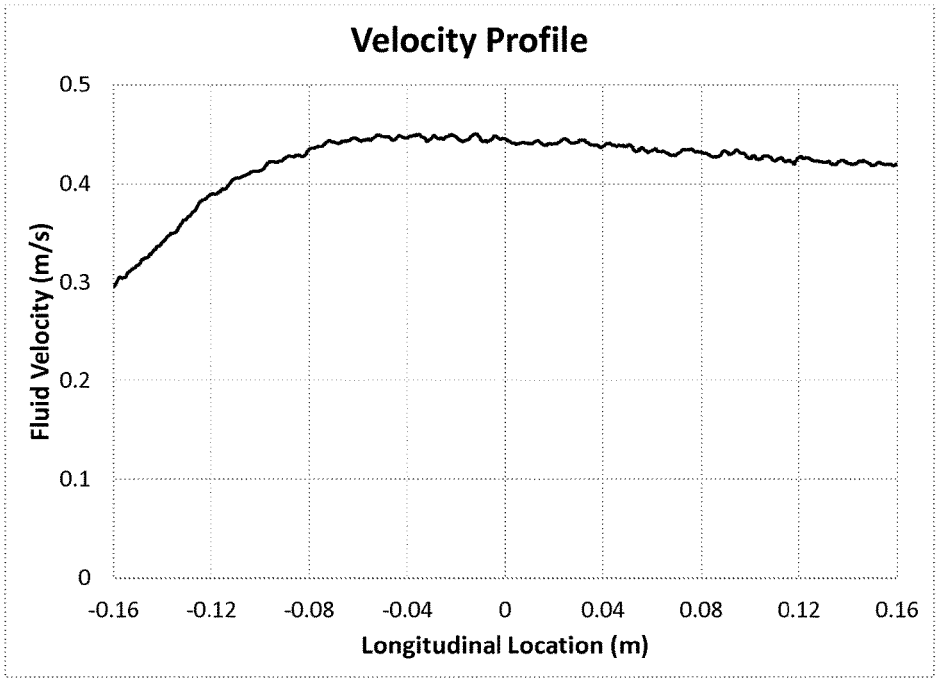

FIGS. 7A-7B are charts 700*a*, 700*b* of example pressures and velocities of printing fluid slightly below where it leaves a channel and arrives at a developer roller for another example developer unit. The other example developer unit may include an inlet with a maximized diameter and with tapering. The example developer unit may not include an insert. In the pressure and velocity charts 700*a*, 700*b*, the pressure and velocity of the printing fluid at the second end may be lower than in the previous charts 600*a*, 600*b*, and the pressure and velocity at the first end may be significantly improved over the previous charts 600*a*, 600*b*. Some difference in pressure and velocity may remain between the first end and the second end.

Figure 8A:
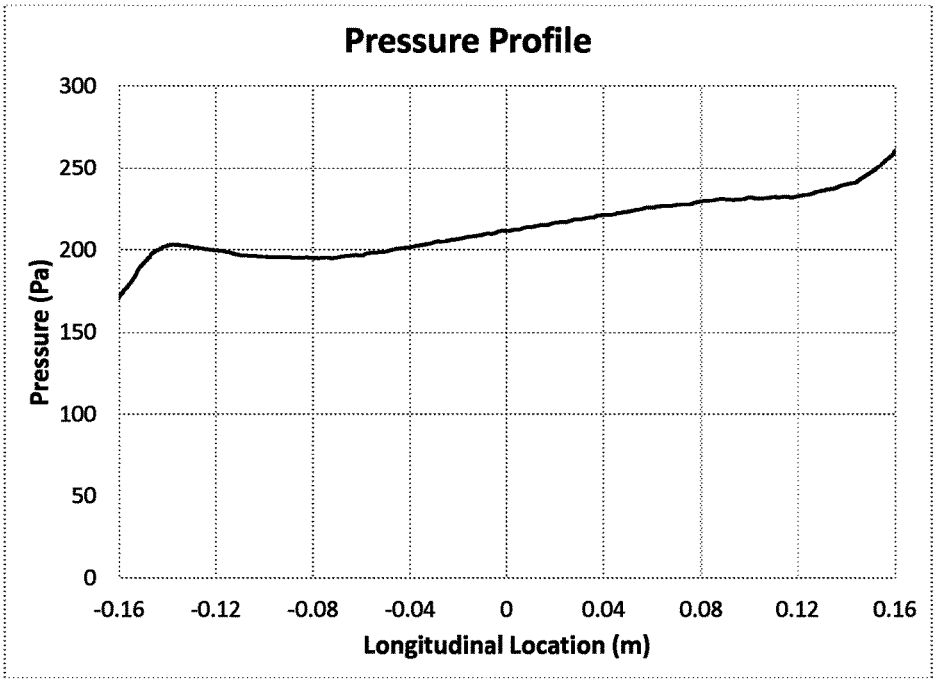
FIGS. 8A-8B are charts of example pressures and velocities of printing fluid slightly below where it leaves a channel and arrives at a developer roller for still another example developer unit.
Figure 8B:
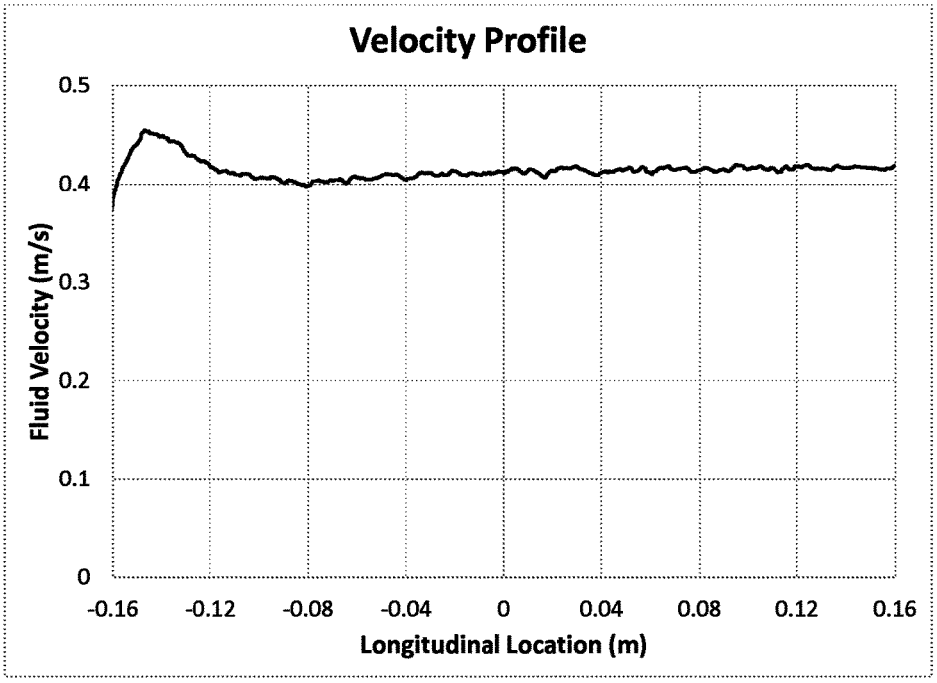

FIGS. 8A-8B are charts 800*a*, 800*b* of example pressures and velocities of printing fluid slightly below where it leaves a channel and arrives at a developer roller for still another example developer unit. The still other example developer unit may include an inlet with a maximized diameter and with tapering. The still other example developer unit may include a solid insert without a hole in the center and without a plurality of ribs. In a pressure chart 800*a*, the pressure may be mostly uniform but slightly increasing between the first and second ends. In a velocity chart 800*b*, the velocity may be mostly uniform but have a spike towards the first end due to fluid deflected upward by the insert.

Figure 9A:
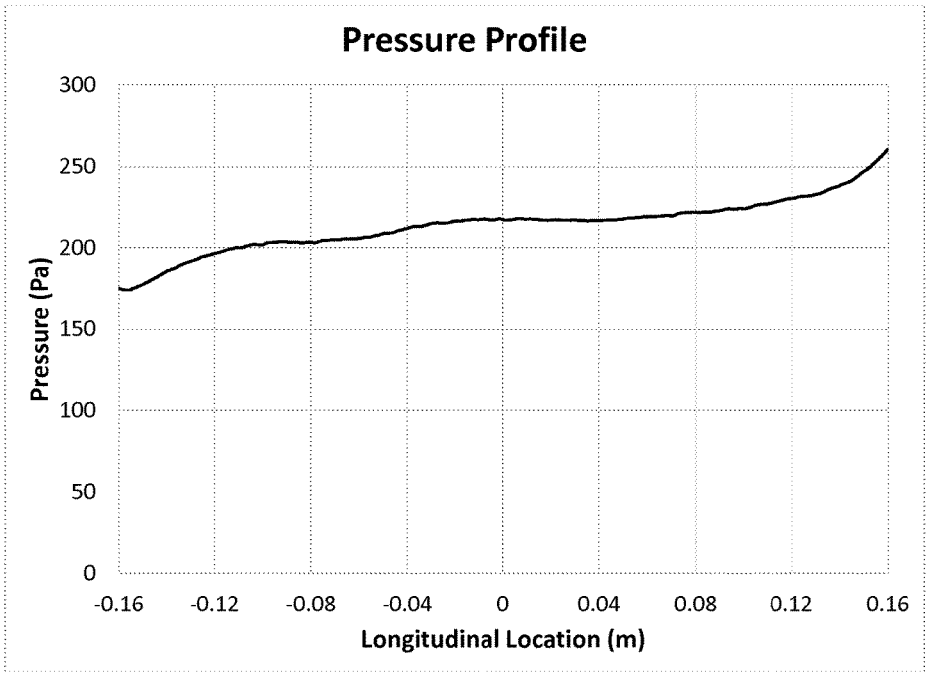
FIGS. 9A-9B are charts of example pressures and velocities of printing fluid slightly below where it leaves a channel and arrives at a developer roller for an additional example developer unit.
Figure 9B:
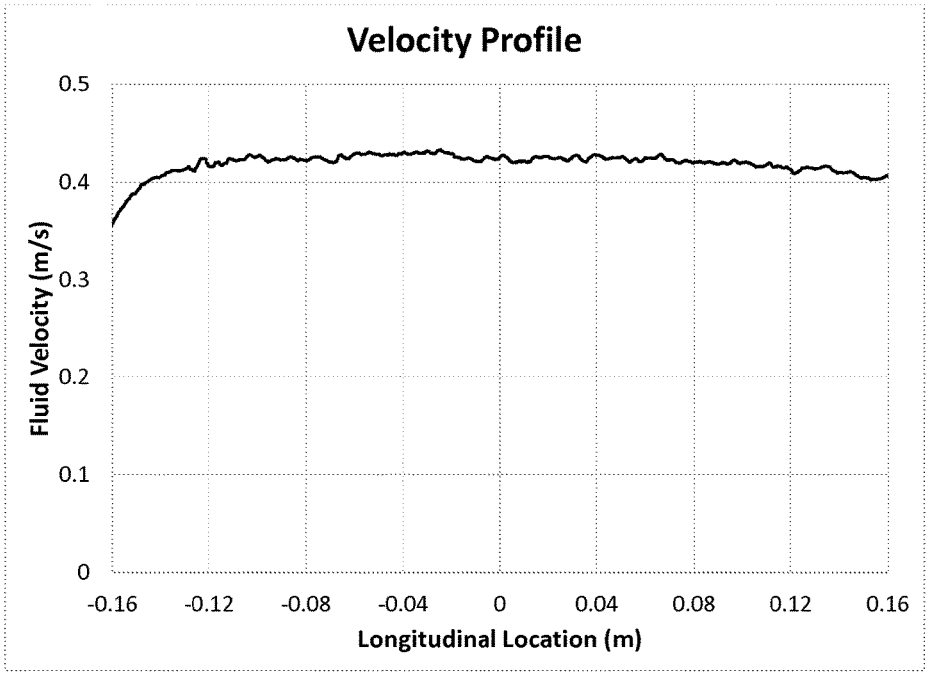

FIGS. 9A-9B are charts 900*a*, 900*b* of example pressures and velocities of printing fluid slightly below where it leaves a channel and arrives at a developer roller for an additional example developer unit. The additional example developer unit may include an inlet with a maximized diameter and with tapering. The additional example developer unit may include an insert with a hole and with a plurality of ribs oriented to direct flow towards the corners of the fluid cavity. The location, orientation, and size of the ribs may also, or instead, be chosen for ease of manufacture. In a pressure chart 900*a*, the pressure may be mostly uniform but slightly increasing between the first and second ends. In a velocity chart 900*b*, the velocity may be mostly uniform without a spike in velocity as occurred in the previous velocity chart 800*b*.

The above description is illustrative of various principles and implementations of the present disclosure. Numerous variations and modifications will become apparent to those skilled in the art once the above disclosure is fully appreciated. Accordingly, the scope of the present application should be determined only by the following claims.

What is claimed is:

1. A developer unit, comprising:

a developer roller;

a set of electrodes proximate to the developer roller, the set of electrodes forming a cavity;

an inlet to the cavity, the inlet to receive printing fluid; and an insert in the inlet, the insert to distribute the printing fluid evenly in the cavity, wherein the inlet includes an endcap distal from the cavity, and wherein the insert is molded into the endcap.

2. The developer unit of claim 1, wherein the insert includes:

a body; and a plurality of ribs to couple the body to the inlet.

3. The developer unit of claim 2, wherein the body includes a hole to transmit fluid through the body.

4. The developer unit of claim 2, wherein the plurality of ribs are positioned to direct fluid to corners of the cavity.

5. A developer unit, comprising:

a developer roller;

a set of electrodes proximate to the developer roller, the set of electrodes forming a cavity;

an insert to distribute the printing fluid evenly in the cavity; and an inlet to the cavity, the inlet to receive printing fluid, wherein the inlet widens from a diameter of a conduit at a distal end of the inlet to a diameter of the cavity at a proximal end of the inlet, the distal end of the inlet to connect to the conduit, wherein the inlet includes an endcap distal from the cavity, and wherein the insert is situated nearer the distal end of the inlet than the proximal end, the insert to direct printing fluid received at the distal end along an inner surface of the inlet.

6. The developer unit of claim 5, wherein the inlet tapers out from the endcap to the size of the cavity.

7. The developer unit of claim 6, wherein the inlet tapers out at slopes no greater than 45 degrees.

8. The developer unit of claim 5, wherein the insert is molded into the endcap.

9. The developer unit of claim 8, wherein the insert reduces a flow velocity of the printing fluid and directs the printing fluid away from a center of the cavity.

10. An interface, comprising:

a distal end to connect to a conduit;

a proximal end to connect to a developer unit electrode cavity;

a body widening from a conduit diameter at the distal end to a size of the developer unit electrode cavity at the proximal end;

an endcap at the distal end of the body; and an insert situated nearer the distal end of the body than the proximal end, the insert to direct printing fluid received at the distal end along an inner surface of the body.

11. The interface of claim 10, wherein the insert is molded into the endcap.

12. The interface of claim 10, wherein the insert includes a hole to direct printing fluid towards a center of the developer unit electrode cavity.

13. The interface of claim 10, wherein the insert includes a plurality of ribs to couple the insert to the body, and wherein the plurality of ribs are positioned to direct fluid towards corners of the developer electrode cavity.

14. The interface of claim 10, wherein the insert has a same size cross-section for its entire depth.

* * * * *